US006619745B2

(12) United States Patent
Roberts et al.

(10) Patent No.: US 6,619,745 B2
(45) Date of Patent: Sep. 16, 2003

(54) CONNECTION ASSEMBLY FOR A CHAIR BACK

(75) Inventors: Simon Vincent Harby Roberts, Stockport (GB); Mark Grant Jones, Leyland (GB)

(73) Assignee: Unit Press Limited, Preston (GB)

( * ) Notice: Subject to any disclaimer, the term of this patent is extended or adjusted under 35 U.S.C. 154(b) by 54 days.

(21) Appl. No.: 09/727,641

(22) Filed: Dec. 1, 2000

(65) Prior Publication Data

US 2001/0002763 A1 Jun. 7, 2001

(30) Foreign Application Priority Data

Dec. 3, 1999 (GB) ..... 9928509

(51) Int. Cl.[7] ..... A47C 7/40
(52) U.S. Cl. ..... 297/383
(58) Field of Search ..... 297/353, 383, 297/411.37

(56) References Cited

U.S. PATENT DOCUMENTS

| | | | | |
|---|---|---|---|---|
| 2,973,031 A | * | 2/1961 | Cramer, Jr. | 297/383 |
| 4,012,158 A | | 3/1977 | Harper | |
| 4,102,549 A | * | 7/1978 | Morrison et al. | 297/383 |
| 4,451,084 A | | 5/1984 | Seeley | |
| 4,536,031 A | * | 8/1985 | Latone | 297/353 |
| 4,639,039 A | | 1/1987 | Donovan | |
| 4,660,885 A | | 4/1987 | Suhr et al. | |
| 4,749,230 A | | 6/1988 | Tornero | |
| 4,930,840 A | | 6/1990 | Tornero | |
| 5,026,117 A | | 6/1991 | Faiks et al. | |
| 5,037,158 A | | 8/1991 | Crawford | |
| 5,348,372 A | | 9/1994 | Takamatsu et al. | |
| 5,375,912 A | | 12/1994 | Stulik et al. | |
| 5,511,852 A | * | 4/1996 | Kusiak et al. | 297/383 |
| 5,547,253 A | | 8/1996 | Schwartz et al. | |
| 5,582,460 A | | 12/1996 | Schultz | |
| 5,584,533 A | | 12/1996 | Schrewe | |
| 5,586,809 A | | 12/1996 | Szmadzinski | |
| 5,597,204 A | | 1/1997 | Karaus, Jr. | |
| 5,649,741 A | | 7/1997 | Beggs | |
| 5,678,893 A | | 10/1997 | Bock | |
| 5,685,609 A | | 11/1997 | Miotto | |
| 5,695,249 A | | 12/1997 | Lotfi | |
| 5,839,784 A | * | 11/1998 | Breen | 297/383 |
| 5,853,222 A | | 12/1998 | Roslund, Jr. et al. | |
| 5,918,935 A | | 7/1999 | Stulik et al. | |
| 5,951,107 A | | 9/1999 | Tornero | |

FOREIGN PATENT DOCUMENTS

| | | |
|---|---|---|
| EP | 0 587 536 | 3/1994 |
| FR | 2 732 870 | 10/1996 |
| GB | 1 371 641 | 10/1974 |
| GB | 2 180 147 | 3/1987 |

* cited by examiner

*Primary Examiner*—Peter R. Brown
(74) *Attorney, Agent, or Firm*—Hollander Law Firm, P.L.C.

(57) ABSTRACT

A chair having an adjustable seat (1) and back (3) has a connection assembly for connecting the back to an adjustment mechanism (4) of the chair. The assembly has a rigid L-shaped connection bar (7) one end (7*b*) of which is insertable into a receiving structure (4*a*) of the mechanism (4). A catch mechanism is provided to hold this end (7*b*) in a locking position in the receiving structure (4*a*). The catch mechanism can be released e.g. with a screwdriver inserted through a side aperture (26) to allow ready removal of the back (3). The end (7*b*) may have a projection (8) which engages a hole (15) and a spring loaded wedge member (25) may be provided to hold the end (7*a*) between upper and lower plates (17, 12). This wedge member (25) may be slidable back in a slot (20) against the spring loading for release of the catch mechanism.

22 Claims, 4 Drawing Sheets

7
7a
7b
7c
8
9
10
11
12
13
14
15
16
17
18
19
21
22
23
24
25
26
27
28
29
30
31
4a
IV
V

CONNECTION ASSEMBLY FOR A CHAIR BACK

This invention relates to chairs, in particular to chairs of the kind which have a mechanism which adjustably connects a seat part and a back part of the chair to a base part. More particularly the invention is concerned with a connection assembly for connecting the back part to the mechanism of such a chair.

Chairs of this kind are generally well known and used, for example as typists chairs or for sitting and working at a desk equipped with a personal computer. The mechanism may be such as to permit independent movement and positional adjustment of the seat and back parts and advantageously this enables a user to select a comfortable sitting position.

This mechanism can be relatively complex and it is desirable to check to ensure that it is operating correctly and also to ensure that it is sufficiently robustly made and assembled so as to be capable of withstanding the forces placed on it when a person sits on the chair, before the chair is despatched to the customer.

However, for proper checking of the mechanism it is necessary to connect the back part to the mechanism, which generally involves securely bolting a connection bar to the mechanism, whereby the chair then has its back attached which is not convenient for storage and transport purposes. Removal of the back after testing by unbolting the connection bar may not be feasible or convenient and in any case may necessitate rechecking after the back is reassembled to ensure reliability of checking.

An object of the invention is to provide a secure connection assembly for a chair back with which checking of the chair mechanism can be effected reliably whilst facilitating convenient storage and transport of the chair.

According to the invention therefore, there is provided a connection assembly for use with a chair having a base part, a seat part, a back part, and a mechanism for adjustably connecting the seat part and the back part to the base part, said connection assembly being adapted for connecting the back part to the mechanism, wherein the assembly comprises a rigid connection member attachable to the back part so as to provide a free end portion projecting therefrom, and a receiving structure for attachment to the mechanism to receive the said end portion, characterised by the provision of a releasable catch mechanism for releasably locating and securing the end portion in a locking position relative to the receiving structure.

According to the invention there is further provided a chair comprising a base part, a seat part, a back part, a mechanism and an assembly as described above.

With the invention the back part can be securely fixed to the mechanism and the catch mechanism can permit ready movement and replacement as required. Thus the mechanism can be checked before despatch with the back part in place and then the back part can be removed for storage and transport and, finally reinstated on delivery. In so far as the catch mechanism effects location and secural the back part can be reinstated reliably without necessarily requiring re-checking.

The connection member preferably comprises a generally L-shaped bar having two opposite arms linked by a central portion, one said arm being adapted for attachment to the back part and the other arm providing the said end portion. The central portion may be curved. The bar may be a generally flat bar.

The receiving structure preferably comprises opposed side walls secured in spaced apart side-by-side disposition by a base plate, the said end portion being adapted to be secured by the catch mechanism between the walls on top of the base plate. Preferably a further plate is fixed between the walls above the base plate whereby the said end portion is adapted to be secured between the base plate and the further plate.

In a preferred embodiment the catch mechanism includes cooperable configurations on the end portion and the receiving structure which interfit to locate the end portion relative to the receiving structure in the said locking position. The said configurations may comprise a projection on the end portion and an aperture in the receiving structure.

Preferably also the catch mechanism includes a movable catch member which engages the said end portion to hold said end portion in the said locking position. The catch member may comprise a wedge member. Preferably spring means is provided to urge the catch member into a position at which it engages the said end portion.

The said end portion may have thereon a raised part operable to deflect the catch member as the end portion is moved to the said locking position thereof. This raised portion may be a pressed-out part of the aforesaid bar.

The catch member may be provided on a slider mounted for movement along a slide track.

Preferably the receiving structure includes an abutment for engagement with the end portion in the said locking position to resist further longitudinal movement thereof.

The receiving structure may have a side aperture providing access to a part of the catch mechanism to permit manual release thereof.

The invention will now be described further by way of example only and with reference to the accompanying drawings in which.

Figure 1:
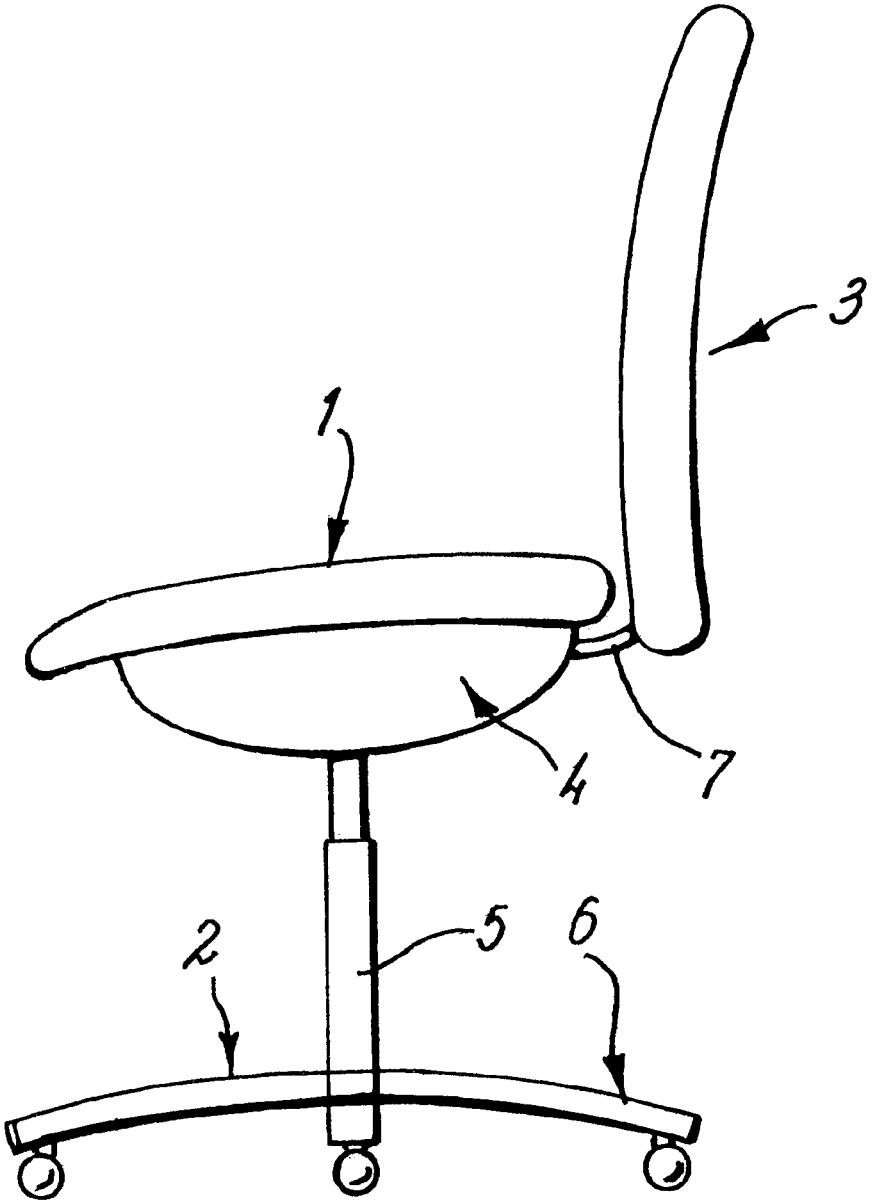
FIG. 1 is a diagrammatic view of a chair incorporating one form of a connection assembly according to the invention.
Figures 2, 4, 5:
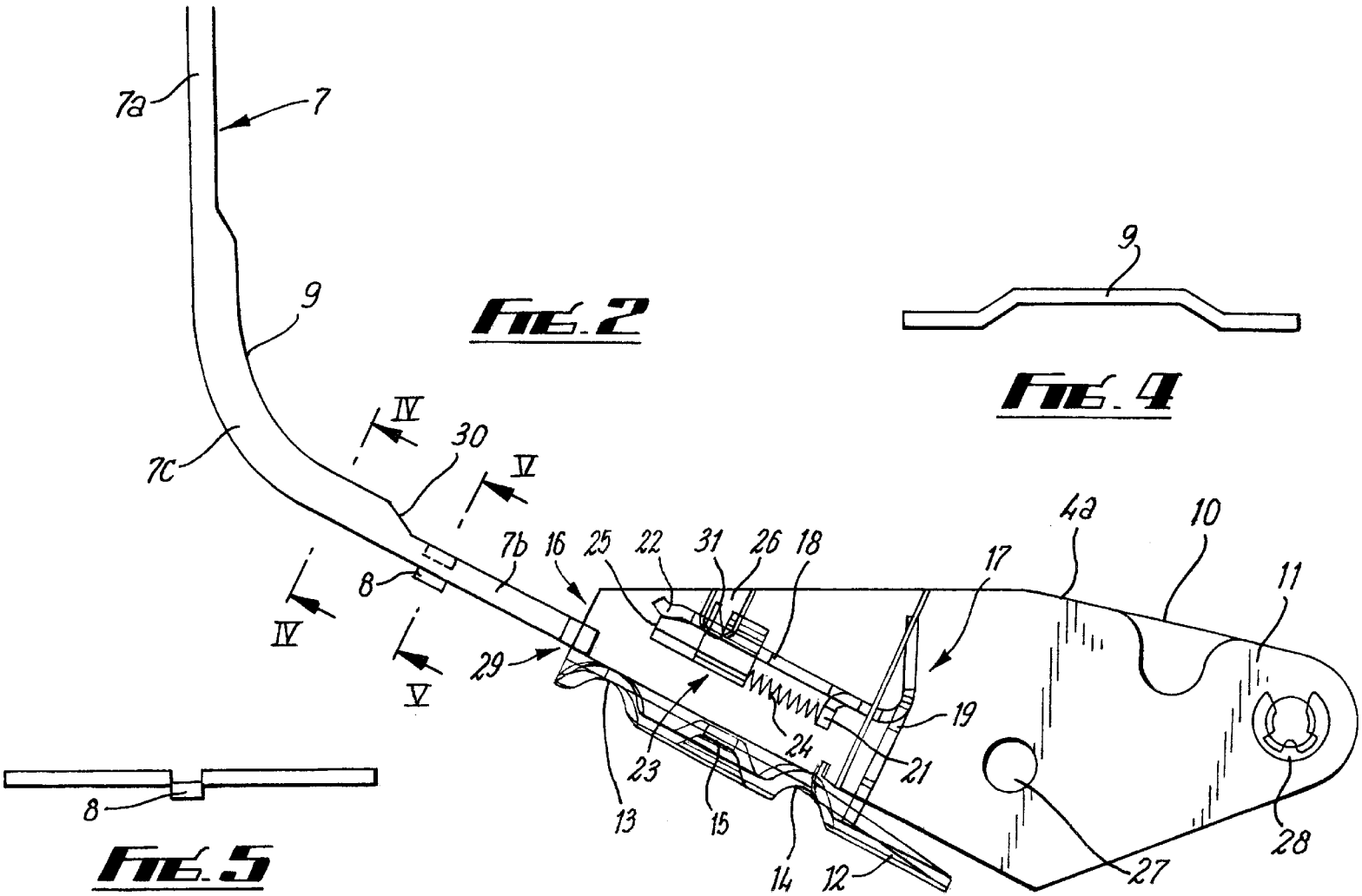
FIG. 2 is a diagrammatic side view of the assembly shown in a disengaged condition.
FIGS. 4 & 5 are cross-sectional views on the lines IV—IV and V—V of FIG. 2.

Referring to the drawings, FIG. 1 shows an office chair having a seat part 1, a base part 2, and a back part 3, all interconnected via a mechanism 4.

The base part 2 comprises a vertical central telescopic support pillar 5 attached at its lower end to a five-arm wheeled floor-engaging structure 6. At its upper end the pillar 5 is attached to the mechanism 4 beneath the seat part 1. In conventional manner the telescopic pillar 5 contains a gas cylinder height adjusting mechanism which is operated by a manual control (not shown) comprising a cam on a shaft which engages with a valve at the end of the gas cylinder, the shaft being rotatable by means of a control knob or lever.

The seat part 1 comprises a padded seat structure on a frame which is attached to a top part of the mechanism 4.

The back part 3 comprises a padded back structure which is adjustably attached to the mechanism 4 by means of a rigid back part connector 7. The connector 7 is generally L-shaped and has straight arms 7*a*, 7*b* linked by a curved central portion 7*c*. One arm 7*a* is upstanding and engages the back part 3 in conventional manner. The other arm 7*b* is disposed level and engages the mechanism 4.

The back part connector 7 is a one piece metal bar which has an upwardly pressed-out channel 9 at its curved central portion 7*c* for strengthening purposes. The arm 7*b* which engages the mechanism 4 has a downwardly directed cylindrical projection 8 formed by a semi-sheer punch. That is, the projection 8 is formed by a punch which sheers almost completely through the metal bar.

The mechanism 4 has a receiving structure 4*a* which the back part connector 7 engages.

This receiving structure 4*a* comprises two side-by-side parallel side walls 10, 11 fixed in spaced apart disposition by means of a transverse base plate 12 welded at opposite upstanding edge regions to opposed coplanar straight lower edges of the side walls 10, 11.

The base plate 12 is shaped to define leading and trailing transverse upwardly directed curved ridges 13, 14 with a through hole 15 centrally between the ridges 13, 14 bounded by a raised collar. The side walls 10, 11 are of like shape tapered towards one end 16 which is an entry end of the receiving structure 4*a*, and the terms leading and trailing are used in relation to this.

Spaced above the base plate 12 there is a transverse intermediate plate 17 welded between the side walls 10, 11.

This intermediate plate 17 is generally T-shaped and has a main body part 18 generally parallel to the base plate 12 and an upstanding integral part 19 at its trailing end.

Figure 6:
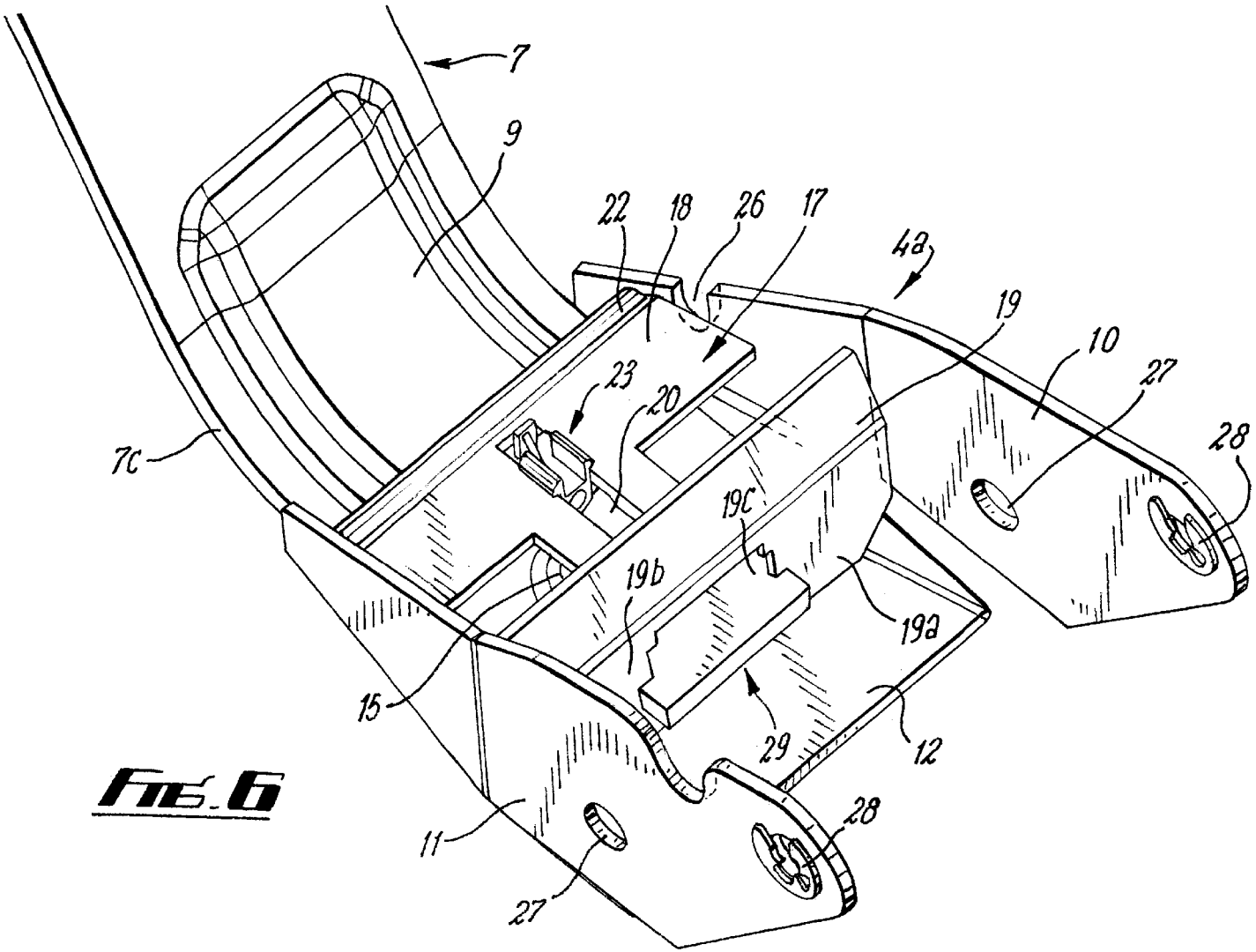
FIG. 6 is a perspective view of the assembly.

As shown in FIG. 6, the body part 18 of the plate 17 has cutaway trailing corner sections and also has a longitudinally extending central slot 20 with a downwardly projecting integral finger 21 at the trailing end of the slot 20.

The leading transverse edge portion of the intermediate plate 17 is shaped to define a downwardly curved ridge 22.

The upstanding part 19 is continuous between the side walls 10, 11 above the body part 18 but is cut away beneath the central region of the body part 18 to define spaced apart upstanding side portions 19*a*, 19*b* with a stepped gap 19*c* therebetween.

A slider 23 is mounted within the slot 20 and is held captive against movement out of the slot upwardly and downwardly by means of transverse abutments on upper and lower parts of the slider. At a trailing end the slider 23 is connected to the finger 21 by means of a helical coil compression spring 24. At a leading end the slider 23 has a catch extension 25 with a downwardly inclined wedge-shaped nose which engages beneath the curved ridge 22. The spring 24 acts to push the extension 25 beneath the ridge 22.

One of the side walls 10 has a cut-out 26 extending down from a top edge thereof to the level of the body part 18 of the intermediate plate 17 in alignment with the leading end of the slot 20.

Central and trailing end regions of the side walls 10, 11 are provided with pivot mountings 27, 28 for attachment of the part 4*a* to other parts of the mechanism 4.

Figure 3:
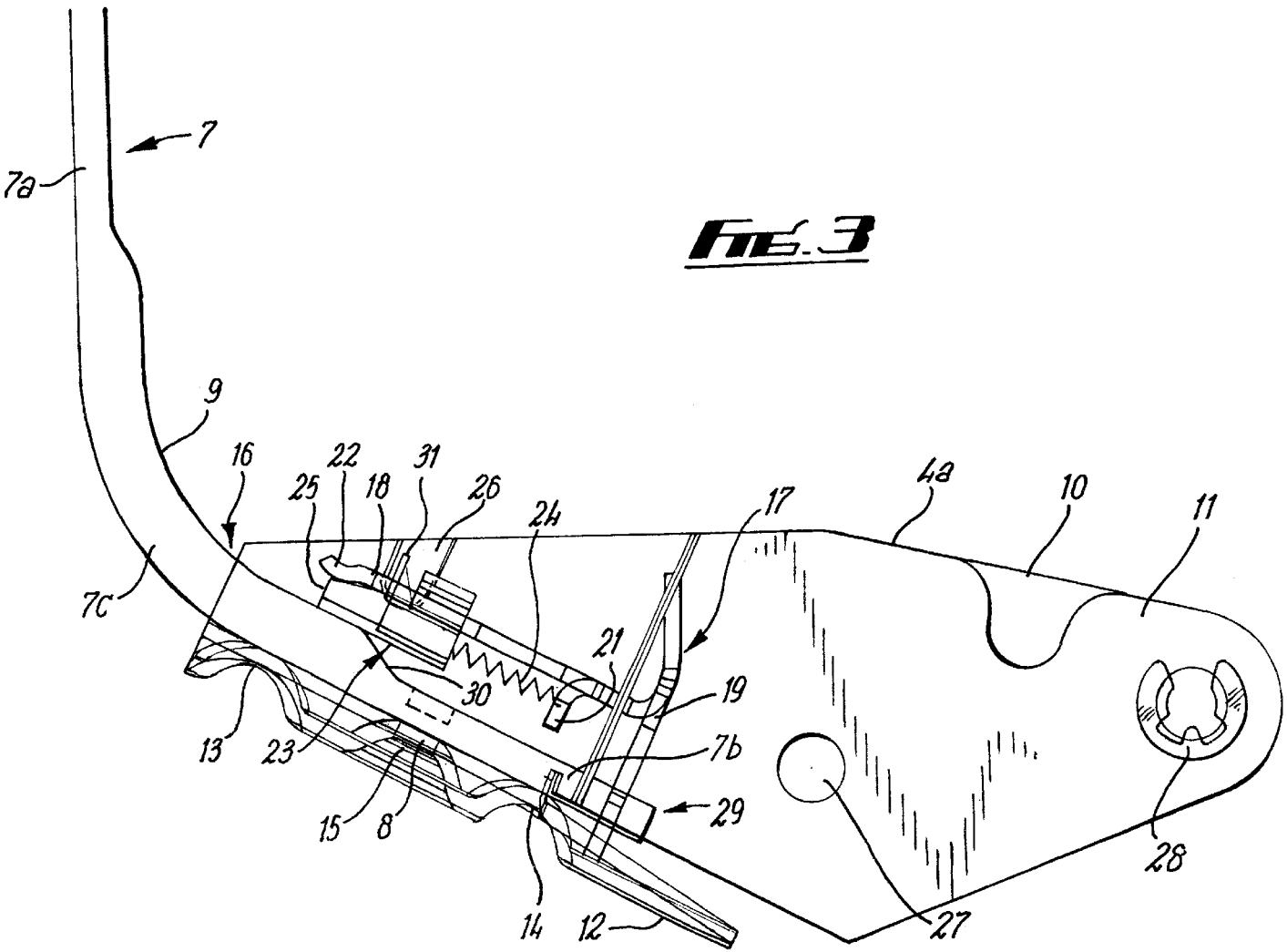
FIG. 3 is a diagrammatic view similar to FIG. 2 showing the assembly in an engaged condition.

In an assembled condition of the chair, as shown in FIG. 3, the arm 7*b* of the connector 7 which projects as a free end portion from the chair back 3, is inserted between the side walls 10, 11 through the entry end 16 and pushed to a position at which the end 29 of the arm 7*b* engages the upstanding part 19 of the intermediate plate 17. The transverse dimension of the connector 7 is essentially equal to the inner spacing of the side walls 10, 11. However, corner sections of the end 29 of the arm 7*b* are cut away to define a central tongue which fits closely between the spaced apart lower side regions 19*a*, 19*b* of the upstanding part 19 within the gap 19*c*.

Further movement of the arm 7*b* is limited by engagement with these side regions 19*a*, 19*b*. As the connector 7 is pushed in, the projection 8 strikes the leading ridge 13 and deflects the connector 7 upwardly whereby the slider 23 is engaged with the leading inclined end 30 of the pressed-out channel 13 so as to be pushed against the action of the spring 24 some way along the slot 20 (away from the position shown in the drawings).

As the connector 7 approaches the limit position the projection 8 becomes aligned above the hole 15. This hole 15 is of very slightly larger diameter than the projection 8 whereby the projection can readily drop into the hole 15. This arrests longitudinal and transverse movement of the arm 7*b* and also allows the arm 7*b* to drop to a position at which it rests on the ridges 13, 14. The slider 23 is now moved back by the compression spring 24 to the position shown in the drawing whereby the catch extension 25 is wedged between the top of the pressed-out channel 9 and the curved ridge 22.

The arm 7*b* is now securely held against movement in any direction.

Notwithstanding this secure retention, the arm 7*b* can be removed as and when required by means of a suitable elongate tool, such as a screwdriver, which can be inserted centrally through the cutout 26, into engagement with the slider 23. As shown, the slider 23 has an upstanding part 31 at its leading edge with a gap therebehind and the screwdriver can be located within this gap. The slider 23 can then be forced back along the slot 22 against the compression spring 24. This allows upward deflection of the arm 7*b* so that the projection 8 can be disengaged from the hole 15 whereby the connector 7 can then be pulled out of the mechanism 4.

With this arrangement the connector 7 readily snap fits into a predetermined precisely located locking position and can be removed and reinserted as desired. This means that the chair can be completely assembled for checking purposes and the back can then be removed for ease of storage and transport with the reassurance that the chair can be safely and securely reassembled in a simple and convenient manner on delivery without requiring re-checking.

It is of course to be understood that the invention is not intended to be restricted to the details of the above embodiment, which is described by way of example only.

Thus, for example, the pillar 5 need not be vertical but may be disposed in any suitable manner.

The forward edge 30 of the channel 9 of connector 7 need not be used as the part which engages the catch 25; a separate formation on the connector 7 could be used for the same purpose.

What is claimed is:

1. A connection assembly for use with a chair having a base part, a seat part, a back part and a mechanism for adjustably connecting the seat part and the back part to the base part, said connection assembly being adapted for connecting the back part to the mechanism, wherein the assembly comprises a rigid connection member attachable to the back part so as to provide a free end portion projecting therefrom, and a receiving structure for attachment to the mechanism to receive said end portion, wherein a releasable catch mechanism is provided for releasably locating and securing said end portion in a locking position relative to the receiving structure, wherein the catch mechanism includes a movable catch member which engages said end portion to hold said end portion in the said locking position, and wherein said end portion has thereon a raised part operable to deflect the catch member as the end portion is moved to said locking position thereof.

2. An assembly according to claim 1 wherein the connection member comprises a generally L-shaped bar having two opposite arms linked by a central portion, one said arm being adapted for attachment to the back part and the other arm providing the said end portion.

3. An assembly according to claim 2 wherein the central portion is curved.

4. An assembly according to claim 1 wherein the receiving structure comprises opposed side walls secured in spaced apart side-by-side disposition by a base plate, the said end portion being adapted to be secured by the catch mechanism between the walls on top of the base plate.

5. An assembly according to claim 4 wherein a further plate is fixed between the walls above the base plate whereby the said end portion is adapted to be secured between the base plate and the further plate.

6. An assembly according to claim 1 wherein the catch mechanism includes cooperable configurations on the end portion and the receiving structure which interfit to locate the end portion relative to the receiving structure in the said locking position.

7. An assembly according to claim 6 wherein the said configurations comprise a projection on the end portion and an aperture in the receiving structure.

8. An assembly according to claim 1 wherein the catch member comprises a wedge member.

9. An assembly according to claim 1 wherein the receiving structure includes an abutment for engagement with the end portion in said locking position to resist further longitudinal movement thereof.

10. An assembly according to claim 1 wherein the receiving structure has a side aperture providing access to a part of the catch mechanism to permit manual release thereof.

11. An assembly according to claim 1, wherein a spring means is provided to urge the catch member into a position at which it engages said end portion.

12. A connection assembly for use with a chair having a base part, a seat part, a back part and a mechanism for adjustably connecting the seat part and the back part to the base part, said connection assembly being adapted for connecting the back part to the mechanism, wherein the assembly comprises a rigid connection member attachable to the back part so as to provide a free end portion projecting therefrom, and a receiving structure for attachment to the mechanism to receive said end portion, wherein a releasable catch mechanism is provided for releasably locating and securing said end portion in a locking position relative to the receiving structure, wherein the catch mechanism includes a movable catch member which engages said end portion to hold said end portion in the said locking position, and wherein the catch member is provided on a slider mounted for movement along a slide track.

13. An assembly according to claim 12 wherein the connection member comprises a generally L-shaped bar having two opposite arms linked by a central portion, one said arm being adapted for attachment to the back part and the other arm providing said end portion.

14. An assembly according to claim 13 wherein the central portion is curved.

15. An assembly according to claim 12 wherein the receiving structure comprises opposed side walls secured in spaced apart side-by-side disposition by a base plate, said end portion being adapted to be secured by the catch mechanism between the walls on top of the base plate.

16. An assembly according to claim 15 wherein a further plate is fixed between the walls above the base plate whereby said end portion is adapted to be secured between the base plate and the further plate.

17. An assembly according to claim 12 wherein the catch mechanism includes cooperable configurations on said end portion and the receiving structure which interfit to locate said end portion relative to the receiving structure in said locking position.

18. An assembly according to claim 17 wherein said cooperable configurations comprise a projection on said end portion and an aperture in the receiving structure.

19. An assembly according to claim 12 wherein the catch member comprises a wedge member.

20. An assembly according to claim 12 wherein the receiving structure includes an abutment for engagement wit said end portion in said locking position to resist further longitudinal movement thereof.

21. An assembly according to claim 12 wherein the receiving structure has a side aperture providing access to a part of the catch mechanism to permit manual release thereof.

22. An assembly according to claim 12, wherein a spring means is provided to urge the catch member into a position at which it engages said end portion.

* * * * *